US005645176A

United States Patent [19]

Jay

[11] Patent Number: 5,645,176

[45] Date of Patent: Jul. 8, 1997

[54] DISPLAY RACK WITH CHANNEL FRONT MEMBER

[75] Inventor: Richard Jay, Westport, Conn.

[73] Assignee: Display Technologies, Inc., Whitestone, N.Y.

[21] Appl. No.: 694,310

[22] Filed: Aug. 8, 1996

[51] Int. Cl.[6] ..... A47F 1/04

[52] U.S. Cl. ..... 211/59.2; 211/59.3; 211/74; D6/408

[58] Field of Search ..... 211/59.2, 59.3, 211/74, 175, 184; 312/42, 71; D6/408; 403/353, 375

[56] References Cited

U.S. PATENT DOCUMENTS

| | | | |
|---|---|---|---|
| D. 277,154 | 1/1985 | Nasgowitz | D6/408 |
| D. 317,382 | 6/1991 | Polvere | D6/408 |
| 3,484,226 | 12/1969 | Golightly | 65/291 |
| 3,905,484 | 9/1975 | Dean et al. | 211/184 |
| 3,986,780 | 10/1976 | Nivet | 403/353 |
| 3,990,375 | 11/1976 | Adams | 403/353 X |
| 4,228,903 | 10/1980 | Eckert | 211/59.2 |
| 4,395,955 | 8/1983 | Pfeifer | 108/61 |
| 4,460,096 | 7/1984 | Ricci | 211/184 |
| 4,488,653 | 12/1984 | Belokin | 211/184 |
| 4,598,828 | 7/1986 | Young et al. | 211/59.2 |
| 4,618,063 | 10/1986 | Mendenhall | 211/184 |
| 4,690,287 | 9/1987 | Fershko et al. | D6/408 X |
| 4,712,694 | 12/1987 | Breslow | 211/184 |
| 4,724,968 | 2/1988 | Wombacher | 211/59.3 |
| 4,730,741 | 3/1988 | Jackle, III et al. | 312/71 X |
| 4,762,236 | 8/1988 | Jackle, III et al. | D6/408 X |
| 4,763,796 | 8/1988 | Flum | 211/59.2 |
| 4,785,945 | 11/1988 | Rowse et al. | 312/42 X |
| 4,801,025 | 1/1989 | Flum et al. | 211/128 |
| 4,836,390 | 6/1989 | Polvere | 211/59.3 |
| 4,907,707 | 3/1990 | Crum | 211/59.3 |
| 4,942,967 | 7/1990 | Schneider | 211/74 |
| 4,942,968 | 7/1990 | Fast | 211/184 |
| 4,960,210 | 10/1990 | Spamer | 211/59.2 |
| 4,997,094 | 3/1991 | Spamer et al. | 211/153 |
| 5,012,936 | 5/1991 | Crum | 211/59.3 |
| 5,024,336 | 6/1991 | Spamer | 211/59.2 |
| 5,050,748 | 9/1991 | Taub | 211/59.2 |
| 5,069,349 | 12/1991 | Wear et al. | 211/59.3 |
| 5,076,443 | 12/1991 | Trulaske, Sr. | 211/59.2 |
| 5,131,563 | 7/1992 | Yablans | 312/71 X |
| 5,154,299 | 10/1992 | Hwang | 211/11 |
| 5,205,421 | 4/1993 | Bustos | 211/59.2 |
| 5,232,102 | 8/1993 | Ozawa | 211/49.1 |
| 5,240,126 | 8/1993 | Foster et al. | 211/59.3 |
| 5,265,738 | 11/1993 | Yablans et al. | 211/59.3 |
| 5,351,838 | 10/1994 | Flum | 211/59.2 |
| 5,366,099 | 11/1994 | Schmid | 312/71 X |
| 5,417,333 | 5/1995 | Flum | 211/59.2 |
| 5,458,248 | 10/1995 | Alain | 211/175 |
| 5,531,336 | 7/1996 | Parham et al. | 211/59.2 X |
| 5,562,217 | 10/1996 | Salveson et al. | 211/59.3 |

*Primary Examiner*—Leslie A. Braun
*Assistant Examiner*—Sandra Snapp
*Attorney, Agent, or Firm*—Amster, Rothstein & Ebenstein

[57] ABSTRACT

A display rack for supporting and displaying articles, includes a plurality of elongate channels, each channel being of integral, one-piece, unitary construction formed in a single plastic molding operation. Each channel defines a pair of laterally spaced upstanding sidewalls, a substantially planar track connecting the sidewalls at the bottoms thereof, and a front member spaced above the track and connecting the sidewalls. The bottom of the front member, the front of the track, and the front of the sidewalls cooperatively define an aperture through which a substantial portion of a lead article in the channel may be viewed. The channels are secured in side-by-side, longitudinally parallel and transversely adjacent relationship. Preferably, the front of the track is devoid of any transversely extending upstanding lip or wall.

28 Claims, 5 Drawing Sheets

FIG. 4
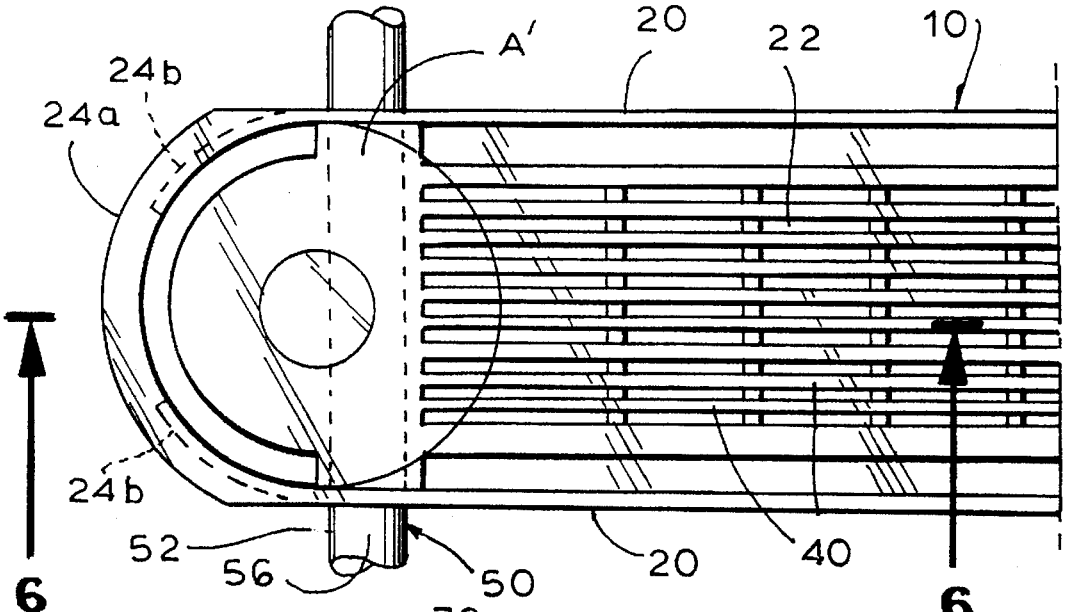
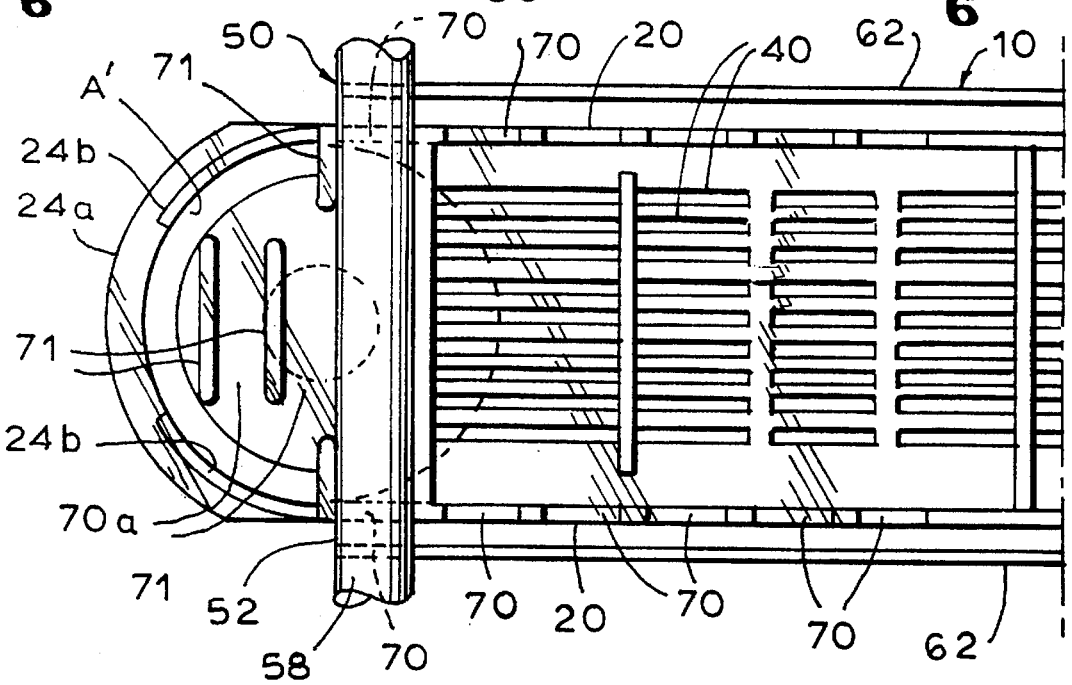
FIG. 5

FIG. 7
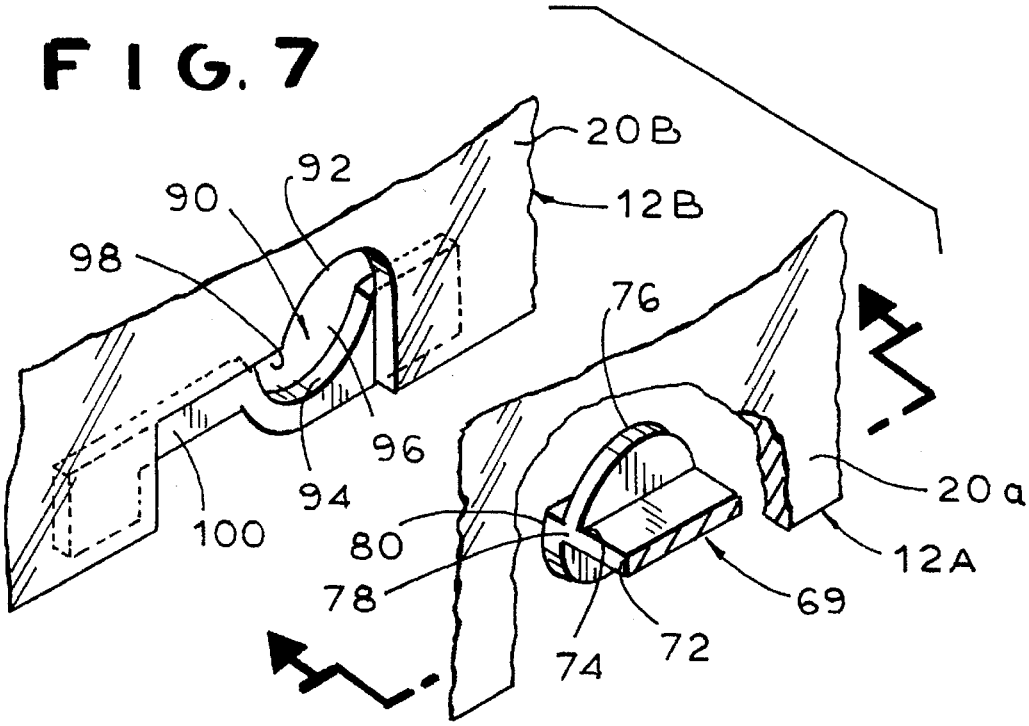
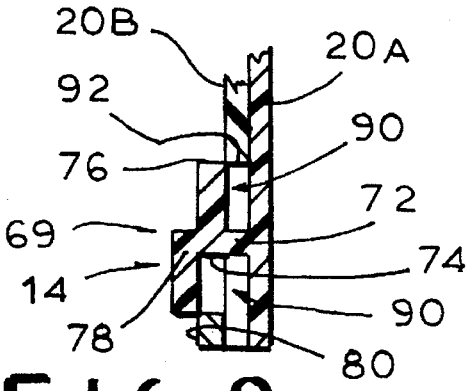
FIG. 9
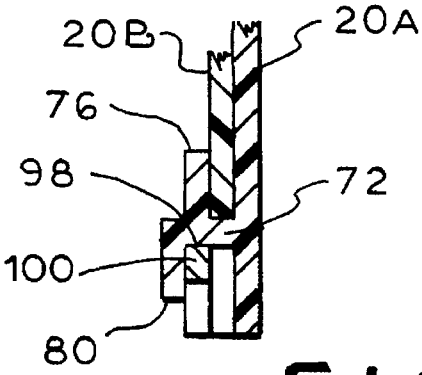
FIG. 10
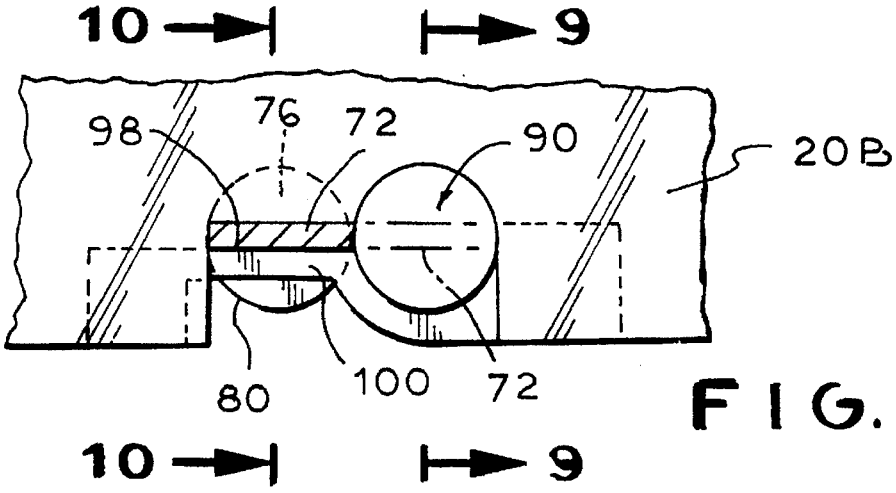
FIG. 8

DISPLAY RACK WITH CHANNEL FRONT MEMBER

BACKGROUND OF THE INVENTION

The present invention relates to a display rack having side-by-side channels, and more particularly to such a display rack wherein each channel has a front member spaced above the track.

Typically a display rack for supporting and displaying articles is either of a horizontal type—wherein a spring or some other means must be provided to move the articles (e.g., bottles) in the channel forwardly as the lead article is removed therefrom—or a gravity fed type—wherein the front is inclined downwardly so that the articles in the channel move forwardly under the influence of gravity as the lead article is removed from the channel. The display rack defines a plurality of channels, the various channels typically being united by virtue of a common floor or track, with the sidewalls of each channel being defined by movable partition members or, in the case of the outer sidewalls of the outer channels, the upstanding sidewalls of the track or floor member.

The present invention is especially adapted for use as a gravity-fed display rack wherein the articles freely move down the channel, on top of the track and intermediate the sidewalls, under the influence of gravity.

In a conventional display rack the track of each channel is provided with either a front wall or a front lip which extends upwardly in front of the track a short distance sufficient to restrain further forward movement of an article traveling down the channel. Because it is desirable for the display rack to put on view to a potential customer as much as possible of the front of the leading article in the channel, the front wall or front lip is typically only an inch or two high, often less than that. However, as the articles increase in size—most commonly by the articles being made taller—there is an increasing tendency for the articles encountering the front wall or front lip to topple forwardly over that front wall or lip and either to rest thereon at an angle or to fall from the display rack entirely onto the floor. The tendency of the articles encountering the front wall or lip to topple forwardly arises out of the fact that, for reasons concerned with the molding operation, the back of the front lip is typically not strictly vertical, but rather sloped upwardly and forwardly. Where the track is dirty and contains debris or sticky particles, the article may topple forwardly as it travels down the track, even before it reaches the front wall or front lip. Where the article is the only article in the channel, there is also a tendency for the article, after hitting the front wall or lip, to bounce back and topple backwards onto the track.

In order to overcome this toppling tendency, many display racks have been provided with a transversely extending front member which is secured to or passes through the sidewalls of the channels and is disposed at a height above the top of the track such that the front member cooperates with the raised front wall or lip in arresting the forward motion of the article down the channel, presumably without toppling of the same. Of course, one disadvantage of the provision of such a front member is that, like the front wall or lip, it interferes with a full viewing of the front of the lead article by the potential customer. A further disadvantage of the known front members is that they must be assembled by the user with the remainder of the display rack into an operating position. Thus, there is introduced the additional expense of at least one additional piece which must be shipped and manually assembled at the site in order to provide a front member. The joint between the display rack and the additional piece is typically not as strong as it would have been if the additional piece were an original molded portion of the display rack. The sidewalls of the channel must also be of greater thickness than otherwise to receive and maintain the additional piece; this is unacceptable because thicker channel sidewalls waste valuable freezer space by reducing the number of channels which a display rack of given width may have. Yet another disadvantage of the known front members is that a single front member serves for all or a plurality of the channels of the display rack, so that, when it is necessary to simply add on or subtract a channel from the display rack, one must have the appropriate number of channels for the front member used by the display rack, thereby destroying the desirable modularity of the display rack system.

In order to provide a full view of the front of the lead article, display racks have been developed wherein the articles are supported not at the bottom thereof, but rather at the top thereof. Thus, the display racks used for bottles may grab the bottles about the neck—see, for example, the display racks available under the tradenames NECK-TRACKER or NECK-GLIDE. Such racks are too expensive for conventional use, however.

In use, there is typically wasted space in front of and behind the display rack. For example, where the shelf supporting the display rack is disposed within a refrigerator, the shelf does not actually extend up to either the front door or the rear wall of the refrigerator and neither does the article-carrying length of the display rack. The failure of the article-supporting display rack length to extend to the rear wall of the refrigerator only wastes space that might otherwise be occupied by articles presented for sale by the display rack. However, the failure of the article-supporting display rack length to extend up to the front panel of the refrigerator furthermore reduces the visibility of the lead article in each channel to the potential customer and invites the retailer to affix signs and other items on the rear of the front panel, such items blocking the leading articles from view by the potential customers.

In the use of a fixed width display rack, there is typically wasted space to at least one side of the display rack. For example, where the shelf supporting the display rack is disposed within the refrigerator, unless the display rack fully occupies the shelf supporting it within the refrigerator, space is wasted which could otherwise have been used to store articles for sale. Accordingly, it is desirable to have a modular display rack typically consisting of a five or six channel wide main module, a double width module having two channels side by side, and a single width module having only a single channel. With a variety of such modules, a display rack can be created in situ which typically closely fills the available width of the shelf.

Separate elements, such as clips, have been used for joining the modules together in a side-by-side relationship. Such separate elements, however, often become lost during shipment of the display rack modules to the retailer, are difficult to assemble with the modules, or fail to provide the desired rigidity to the assembled modules. Modules have also been combined without the use of clips to various horizontal or vertically expending dovetail key/keyhole connectors, and the like. Such connectors have been known to create problems for the molders, or result in weak or loose connections, or to be difficult to assemble. Accordingly, the need remains for means for releasably securing modules together which do not create problems for molders and result in a tight and secure connection via a simple assembly process.

Accordingly, it is an object of the present invention to provide a display rack having at least one elongate channel, each channel in one preferred embodiment being of integral, one-piece, unitary construction inexpensively formed in a single plastic molding operation.

Another object is to provide such a display rack, in a preferred embodiment, which has a front member spaced above the track and at least partially bridging the sidewalls so that the bottom of the front member, the top of the front of the track and the front of the sidewalls define an aperture through which the front of a leading article in the channel may be viewed by a potential customer.

A further object is to provide such a display rack which, in one preferred embodiment, is characterized by the front of the track being devoid of any transversely extending upstanding upper wall or lip, and the front member being spaced above the track sufficiently to engage the leading article in the channel adjacent to and above the center of inertia thereof.

It is also an object of the present invention to provide a display rack wherein, in one preferred embodiment, the front of the lead article in the channel is totally visible.

It is a further object of the present invention to provide such a display rack which, in a preferred embodiment, uses a modified key-and-keyhole releasable locking system for a pair of adjacent display rack channels.

It is yet another object to provide a display rack wherein, in one preferred embodiment, the channel can extend forwardly and/or rearwardly beyond the support therefor.

SUMMARY OF THE INVENTION

It has now been found that the above and related objects and advantages of the present invention are obtained in a display rack for supporting and displaying articles comprising a plurality of elongate channels and means for securing the channels in side-by-side, longitudinally parallel and transversely adjacent relationship. Each channel defines a pair of laterally spaced upstanding sidewalls, a substantially planar track connecting the sidewalls at the bottoms thereof, and a front member spaced above the track and at least partially bridging the sidewalls. The bottom of the front member, the top of the front of the track, and the front of the sidewalls cooperatively define an aperture through which a substantial portion of a lead article in the channel may be viewed.

In a preferred embodiment the front member is disposed forwardly of the front of the track, and, more particularly, the front member is disposed forwardly of the front of the track by less than the thickness of an article in the channel. The bottoms of the front member, the front of the track, and the front of the sidewalls define a generally rectangular aperture. The front member preferably is substantially transparent, whereby the front of the lead article in the channel is totally visible. Preferably the entire display rack is formed of transparent polypropylene.

Preferably the front member is spaced above the track sufficiently to engage the lead article in the channel no lower than the center of inertia thereof, and optimally adjacent to and above the center of inertia thereof. The front of the track is devoid of any transversely extending upstanding lip or wall.

The display rack may include, for each channel, an auxiliary front member disposed intermediate the track and the front member and extending at least partially across the channel. The auxiliary front member may be interrupted, with each end thereof extending from a sidewall of the channel towards the other end and terminating before reaching it.

Each channel is preferably of integral, one-piece, unitary construction formed in a single plastic molding operation.

The present invention also encompasses a display rack for use with a supporting tray having at least one of a laterally extending front wall and a laterally extending back wall. The display rack sidewalls are configured and dimensioned to substantially space the bottom of the track above the bottoms of the sidewalls and define a plurality of laterally aligned and laterally spaced bottom opening pairs of upwardly extending recesses adjacent the front and the back thereof for telescopic receipt therewith of at least one of a tray front wall and a tray back wall, respectively, whereby the useful article-carrying length of the display rack may exceed the length of a supporting tray its rests on. The tops of the recesses are preferably below the bottoms of the tracks.

The present invention further encompasses a key-and-keyhole releasable locking system for a pair of adjacent display rack channels. Disposed on one sidewall of one of a pair of adjacent display rack channels, a generally flat lateral projection in the nature of a key. The key has an inner portion substantially flat on both the top and bottom surfaces thereof, a middle portion substantially flat on one of the surfaces and defining a transverse flange extending normal to the substantially flat surface thereof, and an outer portion substantially flat on the other of the surfaces and defining a transverse flange extending normal to the substantially flat surface thereof. Disposed on an adjacent sidewall on the other of the pair of adjacent display rack channels, is a through-hole in the nature of a keyhole. The keyhole has a substantially planar outer portion defining a portion of a keyhole in the plane of said adjacent sidewall and a substantially planar inner portion defining the remaining portion of a keyway keyhole in a plane parallel to said adjacent sidewall plane. The through-hole defines a large passageway enabling passage thereinto of the key, and a restricted passageway communicating with the large passageway and enabling passage thereinto of the key only via the large passageway. When the key is fully inserted into the restricted passageway, the transverse flange of the outer portion of the key bears on an inner surface of the inner portion of the keyhole, and the transverse flange of the central portion of the key bears on an inner surface of the outer portion of the keyhole.

BRIEF DESCRIPTION OF THE DRAWING

The above and related objects, features and advantages of the present invention will be more fully understood by reference to the following detailed description of the present preferred, albeit illustrative, embodiments of the present invention when studied in conjunction with the accompanying drawing wherein:

FIG. 4 is a fragmentary top plan view, taken along the line 4—4 of FIG. 3;

FIG. 5 is a fragmentary bottom plan view, taken along the line 5—5 of FIG. 3;

FIG. 7 is a fragmentary exploded isometric view of the interlocking structure of two adjacent channels;

FIG. 8 is a fragmentary side elevational assembly view of the two interlocked channels, taken along the line 8—8 of FIG. 7, but with the channels interlocked; and FIGS. 9 and 10 are fragmentary sectional views taken along the lines 9—9 and 10—10, respectively, of FIG. 8.

DETAILED DESCRIPTION OF THE PREFERRED EMBODIMENTS

Figure 2:
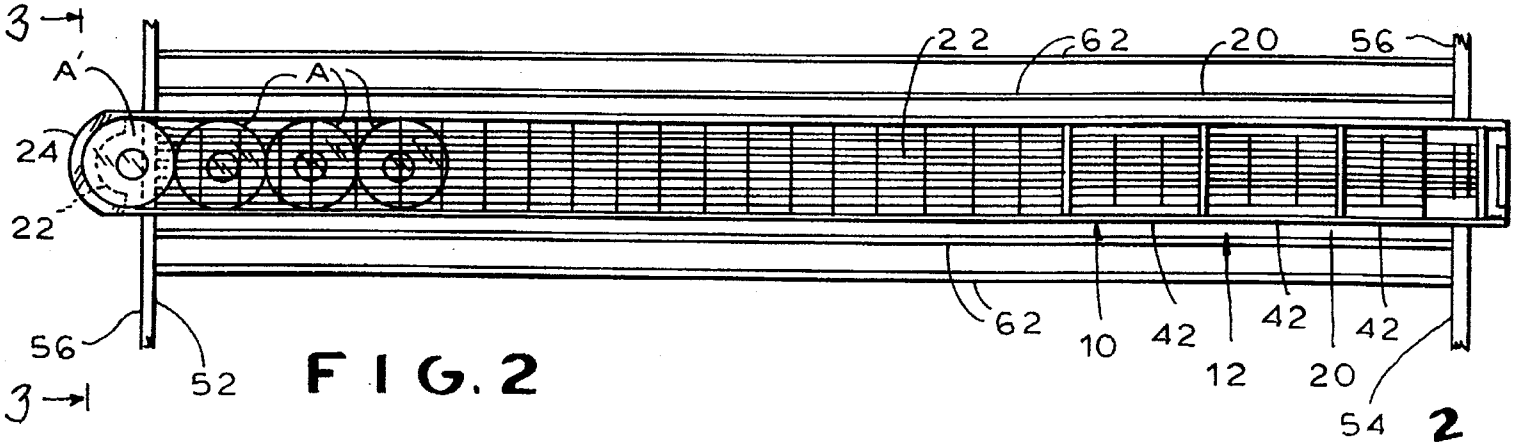
FIG. 2 is a fragmentary top plan view of the bottles, display rack, and shelf, taken along the line 2—2 of FIG. 1.

Referring now to the drawing, and in particular to FIGS. 1–6 thereof, therein illustrated is a display rack according to the present invention, generally designated by the reference numeral 10. The rack 10 comprises at least one elongate channel generally designated 12, with means generally designated 14 being provided for securing a plurality of channels 12 in side-by-side, longitudinally parallel and transversely adjacent relationship. A variety of conventional mechanisms may be used to secure the channels 12 in such a relationship. A preferred means will be described herein below, but it will be recognized that other means may be equally as suitable, albeit with their own special advantages and disadvantages. For example, while clips (not shown) may be used to secure the channels together, clips have a tendency to become lost during shipment and typically do not provide the desirable level of security in locking the channels together.

Figure 1:
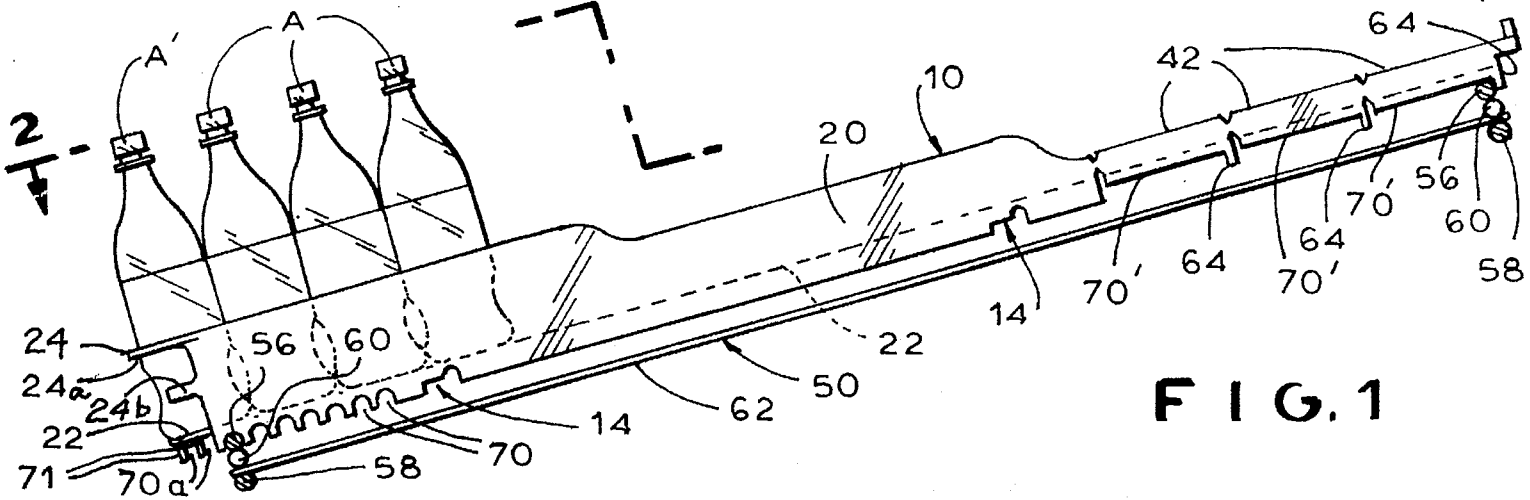
FIG. 1 is a side elevational view of a gravity-fed display rack according to the present invention on a shelf with bottles thereon.

As best seen in FIGS. 1 and 2, each of the elongate channels 12 is an integral, one-piece, unitary construction formed in a single plastic molding operation. The ability of each channel 12 to be formed in a single plastic molding operation greatly reduces the costs thereof, increases the strength thereof, minimizes the width thereof, and avoids the need to keep track of various secondary pieces, such as a separate front member which must at some later time be secured to the channel 12. The channel is preferably formed of a substantially transparent or clear material such as clear polypropylene so that it does not interfere with viewing of the front of the leading article in the channel. Clear polypropylene is not only transparent, but is also stronger, easier to clean and provides better slidability than other materials which have conventionally been used for display racks, such as polystyrene. For economic reasons, one may use, instead of an expensive fully transparent material, a more economical, only substantially transparent material, such as partially clarified polypropylene. While a clear or substantially transparent material is preferred, for reasons that will become apparent hereinafter, opaque materials may be used instead. While polypropylene is somewhat harder to mold than polystyrene, it is believed to provide service because of its easy cleaning, better sliding, stronger and cheaper nature.

In its basic form, each channel 12 defines a pair of laterally spaced, upstanding sidewalls 20 extending the length of the channel, a substantially planar track 22 connecting the sidewalls 20 at the bottoms thereof (and also extending the length of the rack), and a front member 24 spaced above the track 22 and connecting the sidewalls 20 adjacent the fronts thereof. Unlike the tracks of the conventional display racks, the front of the track 22 is preferably devoid of any transversely extending front lip or wall upstanding from the front of track 22. The front member 24 is disposed forwardly of the front of the track 22, preferably by less than the thickness of an article A (e.g., a bottle) illustrated for pedagogic purposes with a transparent cap in the channel 12 so that the bottom of the lead article A' cannot fall into the gap between the vertical plane of the front member 24 and the vertical plane of the back of the front of the track 22. The sidewalls 20 may be rigid or resiliently flexible.

Figure 3:
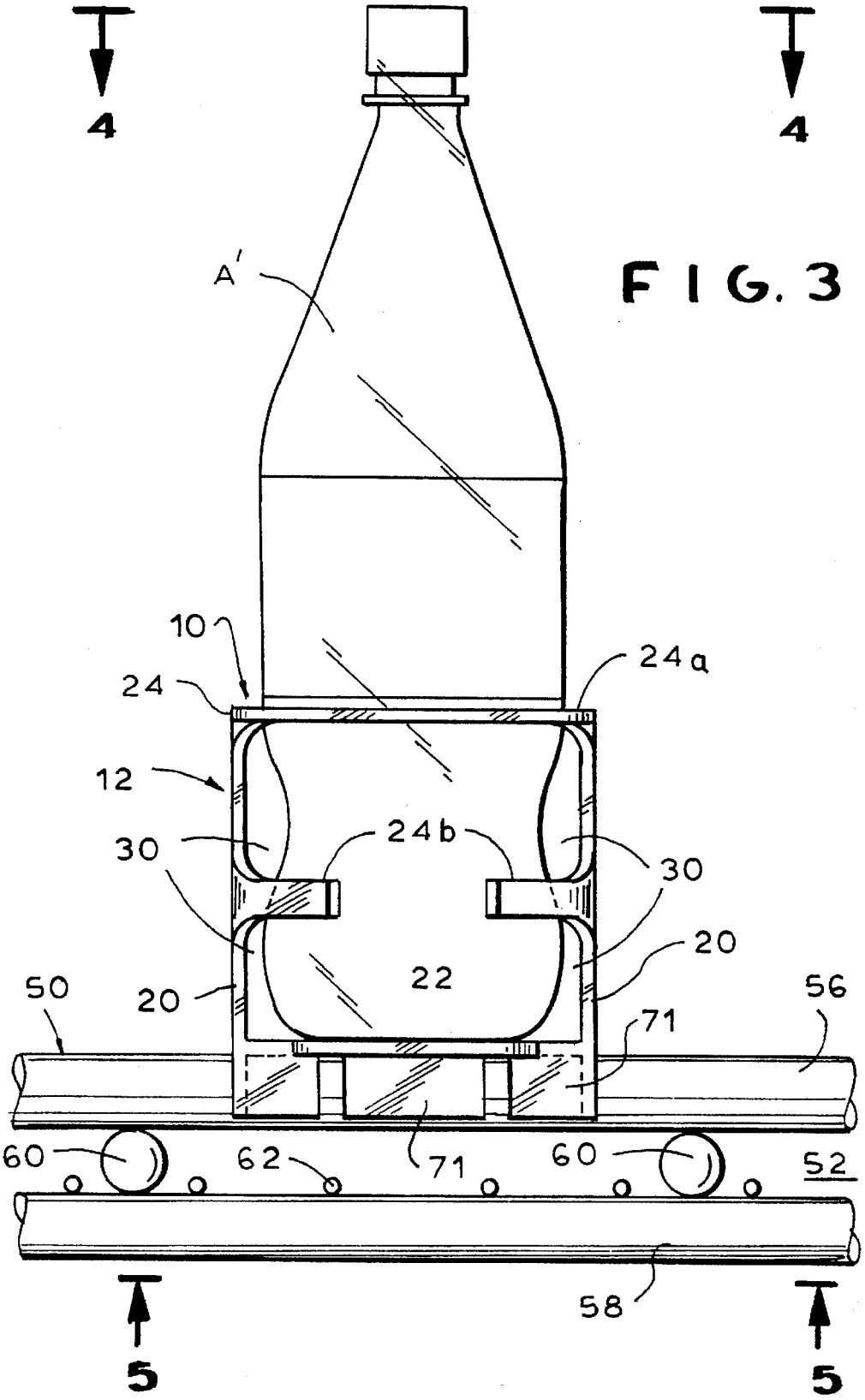
FIG. 3 is a fragmentary front elevational view of the bottles, rack and shelf, to an enlarged scale, taken along the line 3—3 of FIG. 2.
Figure 6:
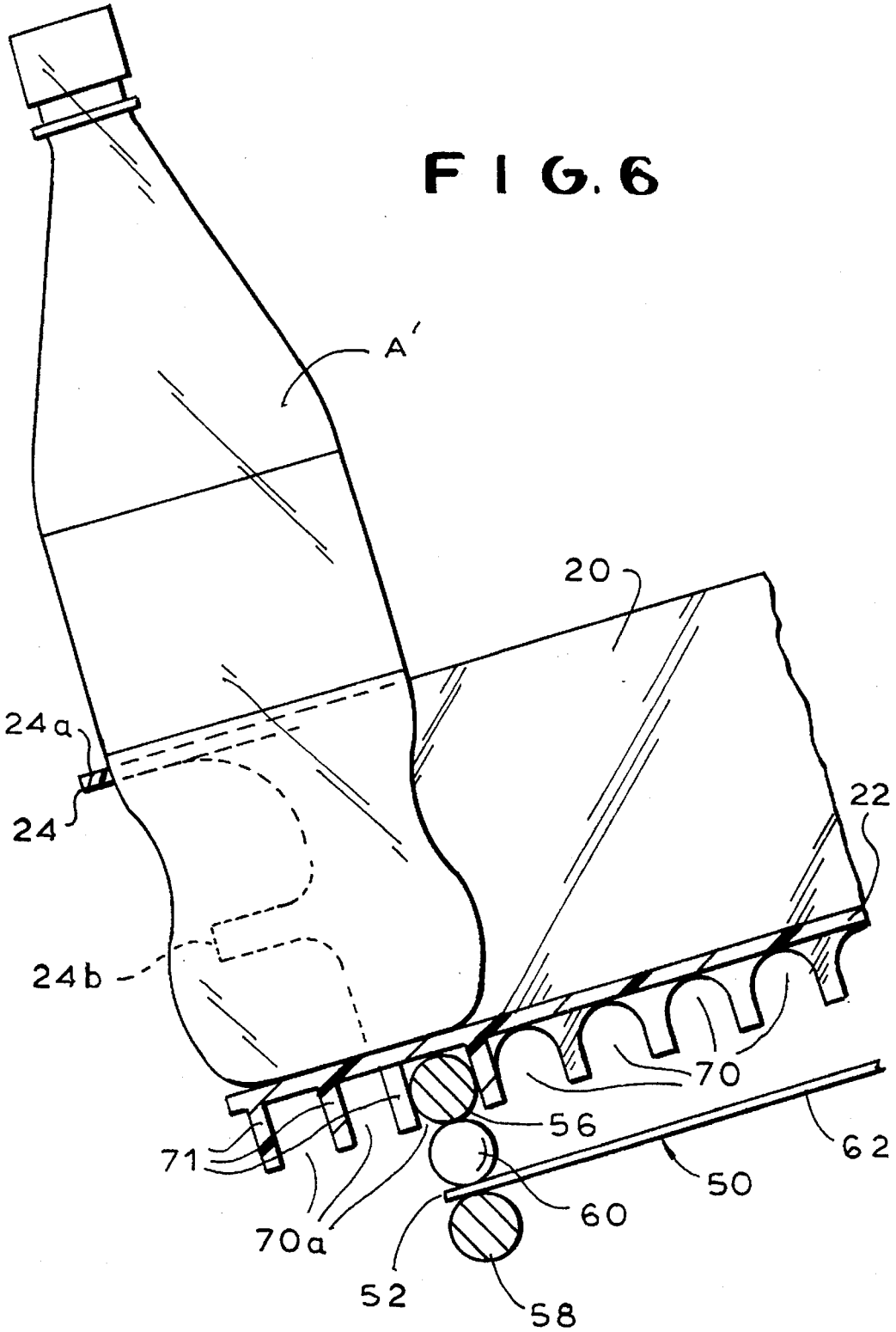
FIG. 6 is a fragmentary sectional view, taken along the line 6—6 of FIG. 4.

As best seen in FIG. 3, the bottom of the front member 24, the top of the front of the track 22 and the front of the sidewalls 20 cooperatively define an aperture 30 through which a substantial portion of the front of a lead article A' in the channel 12 may be viewed by a potential customer. The aperture 30 thus formed is preferably generally rectangular in outline. Where the front member 24 is transparent, the entire front of the lead article in the channel 12 is totally visible due to the absence of any front lip or wall upstanding from the track 22. Even where the front member is not transparent, but assuming that any secondary or auxiliary front wall is either transparent or not present, the aperture 30 typically presents substantially a full quadrant of the lead article A' for view by a potential customer, the quadrant mentioned being the bottom half of the front half of the article. Such a quadrant in the case of a bottle typically extends the full width of the bottle and upwardly for about one third to about one half the height of the bottle, typically an area of about 10 square inches.

In order for the front member 24 to limit the forward movement of the lead article A' in the channel 12, the front member 24 is spaced above the track 22 sufficiently to engage the lead article A' in the channel 12 no lower than the center of inertia thereof, so that there is no tendency for the lead article A' to topple over the front member 24. More particularly, the front member 24 is preferably spaced above the track 22 sufficiently to engage the lead article A' in the channel 12 above the center of inertia thereof, the presence of a second article A immediately behind the first or lead article A' and the weight of the lead article A' cooperating to minimize any tendency of the lead article A' to have the bottom thereof skid forwardly while the upper portion thereof is restrained by the front member 24. Optimally, the front member 24 is spaced above the track 22 sufficiently to engage the lead article A' in the channel 12 adjacent to and above the center of inertia thereof—in other words, closely above the center of inertia thereof.

It will be appreciated that while the front of the track 22 is preferably devoid of any transversely extending lip or wall upstanding therefrom, such an upstanding lip or wall (not shown) may be provided at the front of the track 22, provided that it cooperates with the front member 24 in stopping the forward movement of the lead article in the channel or at least does not interfere with the functioning of the front member 24 in this regard. Such interference might be caused by a lower portion of the upstanding front lip or wall contacting the forwardly traveling article in the channel before the front member 24 does so, with the resultant tendency to topple the lead article forwardly.

As is common in the industry, the track 22 may have on its upper surface, or be constituted substantially by, a plurality of upstanding, longitudinally extending ridges 40 to minimize the friction between the articles A and the track 22 and thereby facilitate movement of the articles down the track under the influence of gravity.

Clearly, the channels 12 according to the present invention may be provided with breakaway back segments 42 so as to enable the overall length of the display rack to be shortened to fit within available refrigeration units, storage areas and the like.

As best seen in FIG. 3, while a single front member 24 has been disclosed for each channel 12, clearly a single front member 24 may be replaced by two or more relatively thin front members 24*a*, 24*b*. The two front members 24*a*, 24*b* may extend in parallel continuously across the channel 12, or one (as illustrated, the bottom one 24*b*) or both may be interrupted to facilitate direct viewing of the lead article A'. The upper front member 24*a* is preferably positioned at a height about the center of inertia of the articles to stop the forward movement of the lead article A' while the lower front member 24*b* is preferably positioned at a height above the track 22 less than the diameter or thickness of the articles A to preclude the ability of a fallen article A sliding down the track 22 to pass intermediate the bottom front member 24*b* and the top of the track 22.

As the display rack is commonly used with round articles, such as bottles, the front member 24 as well as the front of the track 22 have been illustrated as arcuate or curved. It will be appreciated, however, that, for articles having a flat front, the front member 24 (and, if desired, the front of the track 22) may extend flat across the channel 12.

A logo or decorative piece (not shown) may be molded onto the front of the continuous front member 24 during the manufacture thereof or secured thereto at a later time to provide advertising and promotional information.

The display rack 10 is illustrated in FIGS. 1–6 as being supported by a conventional support shelf, generally designated 50. The illustrated conventional support shelf 50 is adapted for use in a refrigeration unit (not shown), although clearly other support shelves (i.e., shelves not for refrigeration units) may also be used. The refrigeration unit shelf is composed of narrow diameter, cylindrical members, rods, wires and the like, secured together with spaces therebetween so as to enable cooling air to pass readily therethrough. The shelf 50 has a transverse front wall 52 and a transverse back wall 54, each such wall 52, 54 being formed of a top rod 56, a bottom rod 58 and a spaced plurality of intermediate spacing balls 60. A plurality of laterally spaced longitudinal members 62 extend from between the bottom rods 58 and the balls 60 at the front wall 52 to between the bottom rods 58 and the balls 60 at the back wall 54.

As illustrated, the shelf 50 is inclined to the horizontal so as to the effect a gravity-feed orientation wherein the bottles move over a slippery track 22 from the shelf rear 54 to the shelf front 52 under the influence of gravity. Alternatively, the shelf 50 may be horizontally oriented and the display rack 10 itself inclined to effect the same motion. As such support shelves are well known, it not deemed necessary to describe the details thereof herein.

The shelf 50 may extend from one sidewall of the refrigeration unit to the other. However, frequently it will not extend either all the way to the rear of the refrigeration unit or all the way to the front of refrigeration unit, or both. In order to enable utilization of the available front and rear space in the refrigeration unit, the display rack 10 is preferably longitudinally oversized relative to the shelf 50 so that it can accommodate additional articles A thereon. Referring now especially to FIGS. 1 and 4–5, adjacent to the front end of the channel 12, the bottoms of the channel sidewalls 20 define a plurality of laterally aligned and laterally spaced pairs of upwardly extending bottom-opening narrow recesses 70. Additionally, the front of the track 22 preferably defines at least one additional narrow recess 70A formed by depending transversely-extending lugs 71. Each of the recesses 70, 70A is configured and dimensioned to receive telescopically therein the upper rod 56 of the front wall 52 of the support shelf 50. This provides flexibility in positioning of the display rack 10 relative to the support shelf 50. The display rack 10 may be positioned on the shelf 50 so that the lead article A' extends at least partially forwardly beyond the shelf 50. Thus the front end of the display rack 10 is positioned on the front end 52 of support shelf 50 such that the releasable and at least partial telescopic engagement between the front wall 52 of the support shelf 50 and a recess 70 or 70A at the bottom of the display rack 10 is relatively snug to limit relative longitudinal movement. Less snugness is required for the releasable and at least partial telescopic engagement of the rear end 54 of the support shelf 50 and one of the breakaway back segments 42 of the display rack 10. Preferably the back portion of the display rack 10 (especially the areas under the breakaway back segments 42, when present) include depending abutment stops 64 which define therebetween upwardly extending, bottom-opening wide recesses 70'. The stops 64 extend transversely across the display rack 10 between the sidewalls 20 and project downwardly therefrom to limit slipping movement of the back of the display rack 10 relative to the back wall 54 of the support shelf 50. Thus, a rear end segment 42 of the display rack 10 may hang over the back wall 54 of the support shelf 50, just as a front end of the display rack can hang over the front wall 52 of the support shelf 50.

The recesses 70, 70A, 70' are configured and dimensioned for telescopic receipt therein of at least one of the support shelf front and back walls, 52, 54 respectively, so that the useful article-carrying length of the display rack 10 may exceed the length of the support shelf 50 it rests on. In other words, the vertical telescopic action between the display rack recesses 70, 70A, 70' and at least one of the support shelf front and back walls 52, 54 enables the article-supporting length of the display rack 10 to exceed the length of the support shelf 50.

It will be appreciated that gaps between the support shelf 50 or display rack 10 and the refrigeration unit back wall, on one hand, and the refrigeration unit front wall, on the other hand, are not essential with elements of the type illustrated as the open spaces therethrough permit cooling air to flow through the support shelf and display rack.

It will be appreciated that there is some sacrifice in the height of the articles which can be used on the display rack so as to enable the above-described channel sidewalls 20 to maintain the bottom of the track 22 spaced above the top of the support shelf 50, and thereby to enable the above-described telescopic action between the display rack and the support shelf and to enable the display rack to have a greater footprint and to hold a greater number of articles.

Refer now to FIGS. 7–10, therein illustrated is the means 14 for securing the channels 12 in side-by-side, longitudinally parallel and transversely adjacent relationship to form the multi-channel display rack 10. A preferred securing means is a key-and-keyhole releasable locking system for a pair of adjacent display rack channels 12A, 12B having adjacent sidewalls 20A and 20B, respectively.

Disposed on an exterior surface of sidewall 20A is a generally flat, lateral projection, generally designated 69, in the nature and configuration of a key. The key projection 69 includes an inner portion 72, a middle portion 74, and an outer portion 78. The inner portion 72 is substantially flat on both the top and bottom surfaces thereof. The middle portion 74 is substantially flat on one of the top and bottom surfaces (as here illustrated, the bottom surface) and defines a transverse flange 76 extending (here, upwardly) normal to the substantially flat surface thereof. The outer portion 78 is substantially flat on the other of the top and bottom surfaces (here, the top surface) and defines a transverse flange 80 extending normal to the substantially flat surface thereof (here, downwardly). In other words, the key projection 69 has an upper flange of 76 and a lower flange 80 disposed in parallel planes.

Disposed on the adjacent sidewall 20B is a through-hole, generally designated 90, in the nature and configuration of a keyhole. A substantially planar outer portion 92 of sidewall 20B defines a portion of the keyhole 90 in the main plane of sidewall 20B, and a substantially planar inner portion 94 of sidewall 20B (formed by a local thickening of the sidewall 20B) defines the remaining portion of the keyhole 90 in a plane parallel to the main sidewall plane. As best seen in FIG. 7, the outer surface 92 of sidewall 20B of channel 12B is cut to define one keyhole half and the inner surface 94 of the sidewall 20B is cut to define the other keyhole half 94. The through-hole 90 resembles a keyhole in that it defines a large passageway 96 enabling passage of the key projection 69 normally thereinto and thereoutof, and a restricted passageway 98 communicating with the large passageway 96 and enabling passage of the key projection 69 thereinto and thereoutof only via the large passageway 96.

When the key projection 69 is fully inserted into the restricted passageway 98, the transverse flange 80 (here, downwardly extending) of the outer portion 78 of the key projection 69 bears on an inner surface of the inner portion 94 of the keyhole 90, and the transverse flange 76 (here, upwardly extending) of the middle portion 74 of the key projection 69 bears on an inner surface of the outer portion 92 of the keyhole 90.

The securing means 14 of the present invention enables a releasable locking system to provide a tight and secure relationship between the two channels 12A and 12B. The securing means 14 accomplishes this by means which produces as tight a joint as a dovetail arrangement, yet does not require the precision crafting of the dovetail arrangement.

To use the securing means 14, the two channels 12A, 12B are placed in side-by-side disposition with the key projection 69 laterally aligned with the keyhole 90. The two channels 12A, 12B are then moved closer together such that sidewalls 20A and 20B are in contact and the key projection 69 extends into and partially through the keyhole 90. At this point, the channel 12A is moved forward relative to channel 12B such that the upper flange 76 bears on the inner surface of the outer portion 92 of sidewall 20B, and the bottom flange 80 bears on the inner surface of the inner portion 94. This action results in the key projection 69 being relocated, within keyhole 90, from the large passageway 96 (see FIG. 9) into the relatively narrow, restricted passageway 98 (see FIG. 10).

To summarize, the present invention provides a display rack having at least one elongate channel, each such channel in one preferred embodiment being of integral, one-piece, unitary construction inexpensively formed in a single plastic molding operation. In another preferred embodiment a front member is placed above the track and at least partially bridges the sidewalls so that the bottom of the front member, the top of the front of the track and the front of the sidewalls defines an aperture through which the front of the leading article in the channel may be viewed by a potential customer. In another preferred embodiment the front of the track is devoid of any transversely extending upstanding upper wall or lip, and the front member is spaced above the track sufficiently to engage the leading article in the channel adjacent to and above the center of inertia thereof. In a further preferred embodiment, the front of the lead article in the channel is totally visible. A preferred embodiment of the display rack uses a modified key-and-keyhole releasable locking system for securing a pair of adjacent display rack channels. In yet another preferred embodiment, the channel can extend forwardly and/or rearwardly beyond the support therefore.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A display rack for supporting and displaying upright elongate articles, comprising:

(A) a plurality of elongate channels, each said channel defining:

(i) a pair of laterally spaced upstanding sidewalls, (ii) a substantially planar article-supporting track connecting said sidewalls at the bottoms thereof, and (iii) a front member spaced above said track, secured to at least one of said sidewalls, and at least partially bridging said sidewalls;

the bottom of said front member, the top of the front of said track, and the front of said sidewalls cooperatively defining an aperture through which an upright substantial portion of a lead article in said channel may be viewed; and (B) means securing said channels in side-by-side, longitudinally parallel and transversely adjacent relationship.

2. The display rack of claim 1 wherein said front member is disposed forwardly of the front of said track.

3. The display rack of claim 2 wherein the front of said member is disposed forwardly of the front of said track by less than the thickness of an article in said channel.

4. The display rack of claim 1 wherein the bottom of said front member, the front of said track, and the front of said sidewalls define a generally rectangular aperture.

5. The display rack of claim 1 wherein said front member is substantially transparent, whereby the front of the lead article in said channel is totally visible.

6. The display rack of claim 1 wherein said display rack is formed of transparent polypropylene.

7. The display rack of claim 1 wherein said front member is spaced above said track sufficiently to engage the upstanding lead article in said channel no lower than the center of inertia of the lead article.

8. The display rack of claim 1 wherein said front member is spaced above said track sufficiently to engage the upstanding lead article in said channel above the center of inertia of the lead article.

9. The display rack of claim 1 wherein said front member is spaced above said track sufficiently to engage the upstanding lead article in said channel adjacent to and above the center of inertia of the lead article.

10. The display rack of claim 1 wherein the front of said track is devoid of any transversely extending upstanding lip or wall.

11. The display rack of claim 1 including, for each channel, an auxiliary front member disposed intermediate said track and said front member and extending at least partially across said channel.

12. The display rack of claim 11 wherein said auxiliary front member is interrupted and each end thereof extends from a sidewall of said channel towards the other end and terminates before reaching it.

13. The display rack of claim 1 wherein said front member is interrupted and each end thereof extends from a sidewall of said channel towards the other end and terminates before reaching it.

14. The display rack of claim 1 for use with a supporting tray having at least one of a laterally extending front wall and a laterally extending back wall, wherein said sidewalls are configured and dimensioned to substantially space the bottom of said track above the bottoms of said sidewalls and define a plurality of laterally aligned and laterally spaced bottom opening pairs of upwardly extending recesses adjacent the front and the back thereof for telescopic receipt therewith of at least one of a tray front wall and a tray back wall, respectively, whereby the article-supporting length of said display rack may exceed the length of a supporting tray.

15. The display rack of claim 14 wherein the tops of said recesses are below the bottoms of said tracks.

16. The display rack of claim 1 additionally including means, for each channel, for substantially spacing the bottom of said track above a supporting tray having at least one of a laterally extending upstanding front wall and a laterally extending upstanding back wall, while simultaneously enabling telescopic receipt of at least one of the front wall and the back wall of the tray therein so that said display rack has an article-supporting length which may overhang and extend beyond at least one of the front wall and back wall of the tray.

17. The display rack of claim 1 wherein each said channel is of integral, one-piece, unitary construction formed in a single plastic molding operation.

18. A display rack for supporting and displaying articles, comprising:

(A) a plurality of elongate channels, each said channel being of integral, one-piece, unitary construction formed in a single plastic molding operation and defining:

(i) a pair of laterally spaced upstanding sidewalls, (ii) a substantially planar track connecting said sidewalls at the bottoms thereof, the front of said track being devoid of any transversely extending upstanding lip or wall, and (iii) a transparent front member formed of polypropylene disposed forwardly of the front of said track and at least partially bridging said sidewalls, said front member being spaced above said track sufficiently to engage an upstanding lead article in said channel adjacent to and above the center of inertia of the lead article;

the bottom of said front member, the top of the front of said track, and the front of said sidewalls cooperatively defining a generally rectangular aperture through which a substantial portion of a lead article in said channel may be viewed, and (B) means securing said channels in side-by-side, longitudinally parallel and transversely adjacent relationship.

19. The display rack of claim 18 including, for each channel, an auxiliary front member disposed intermediate said track and said front member and extending at least partially across said channel.

20. The display rack of claim 19 wherein said auxiliary front member is interrupted and each end thereof extends from a sidewall of said channel towards the other end and terminates before reaching it.

21. A display rack for supporting and displaying articles, for use with a supporting tray having at least one of a laterally extending upstanding front wall and a laterally extending upstanding back wall, comprising:

(A) a plurality of elongate channels defining:

(i) a pair of laterally spaced upstanding sidewalls; and (ii) a substantially planar track connecting said sidewalls at the bottoms thereof; and (B) means securing said channels in side-by-side, longitudinally parallel and transversely adjacent relationship;

said sidewalls being configured and dimensioned to substantially space the bottom of said track above the bottoms of said sidewalls and define a plurality of laterally aligned and laterally spaced pairs of upwardly extending bottom-opening recesses adjacent the front and the back thereof for telescopic receipt therein of at least one of a tray front wall and a tray back wall, respectively, whereby said display rack has an article-supporting length which may exceed the length of a supporting tray it rests on.

22. The display rack of claim 21 wherein the tops of said recesses are below the bottoms of said tracks.

23. The display rack of claim 21 additionally including means, for each channel, for substantially spacing the bottom of said track above a supporting tray having at least one of a laterally extending upstanding front wall and a laterally extending upstanding back wall, while simultaneously enabling telescopic receipt of at least one of the front wall and back wall of the tray therein so that said display rack may overhang and extend beyond at least one of the front wall and back wall of the tray.

24. The display rack of claim 21 wherein each said channel is of integral, one-piece, unitary construction formed in a single plastic molding operation.

25. A display rack for supporting and displaying articles, for use with a supporting tray having at least one of a laterally extending front wall and a laterally extending back wall, comprising:

(A) a plurality of elongate channels defining:

(i) a pair of laterally spaced upstanding sidewalls;

(ii) a substantially planar track connecting said sidewalls at the bottoms thereof; and (iii) means for substantially spacing the bottom of said track above a supporting tray having at least one of a laterally extending upstanding front wall and a laterally extending upstanding back wall, while simultaneously enabling telescopic receipt of the at least one of the front wall and back wall of the tray therein so that said display rack has an article-carrying length which may overhang and extend beyond at least one of the front wall and back wall of the tray; and (B) means securing said channels in side-by-side, longitudinally parallel and transversely adjacent relationship.

26. The display rack of claim 25 wherein each said channel is of integral, one-piece, unitary construction formed in a single plastic molding operation.

27. A key-and-keyhole releasable locking system for a pair of adjacent display rack channels, comprising:

(A) a generally flat lateral projection in the nature of a key disposed on one sidewall of one of a pair of adjacent display rack channels, and having (i) an inner portion substantially flat on both the top and bottom surfaces thereof, (ii) a middle portion substantially flat on one of said surfaces and defining a transverse flange extending normal to the substantially flat surface thereof, and (iii) an outer portion substantially flat on the other of said surfaces and defining a transverse flange extending normal to the substantially flat surface thereof; and (B) a through-hole in the nature of a keyway disposed on an adjacent sidewall on the other of the pair of adjacent display rack channels, and having (i) a substantially planar inner portion defining a portion of a keyhole in the plane of said adjacent sidewall, and (ii) a substantially planar outer portion defining the remaining portion of a keyhole in a plane parallel to said adjacent sidewall plane;

said through-hole defining a large passageway enabling passage of said key, and a restricted passageway communicating with said large passageway and enabling passage of said key only via said large passageway;

whereby, when said key is fully inserted into said restricted passageway, said transverse flange of said outer portion of said key bears on an inner surface of said inner portion of said keyhole, and said transverse flange of said central portion of said key bears on an inner surface of said outer portion of said keyhole.

28. A display rack for supporting and displaying articles, for use with a supporting tray having at least one of a laterally extending front wall and a laterally extending back wall, comprising:

(A) a plurality of elongate channels, each said channel being of integral, one-piece, unitary construction formed in a single plastic molding operation and defining:

(i) a pair of laterally spaced upstanding sidewalls, (ii) a substantially planar track connecting said sidewalls at the bottoms thereof, the front of said track being devoid of any transversely extending upstanding lip or wall, and (iii) a transparent front member disposed forwardly of the front of said track and at least partially bridging said sidewalls, said front member being spaced above said track secured to at least one of said sidewalls, sufficiently to engage a lead article in said channel adjacent to and above the center of inertia of the lead article;

the bottom of said front member, the top of the front of said track, and the front of said sidewalls cooperatively defining an aperture through which a substantial portion of a lead article in said channel may be viewed; and said sidewalls being configured and dimensioned to substantially space the bottom of said track above the bottoms of said sidewalls and define a plurality of laterally aligned and laterally spaced pairs of upwardly extending bottom-opening recesses adjacent the front and the back thereof for the telescopic receipt therein of at least one of a tray front wall and a tray back wall, respectively, whereby the length of said display rack may exceed the length of a supporting tray it rests on; and (B) means securing said channels in side-by-side, longitudinally parallel and transversely adjacent relationship, said securing means including a key-and-keyhole releasable locking system for a pair of adjacent display rack channels, comprising:

(a) a generally flat lateral projection in the nature of a key disposed on one sidewall of one of a pair of adjacent channels, and having (i) an inner portion substantially flat on both the top and bottom surfaces thereof, (ii) a middle portion substantially flat on one of said surfaces and defining a transverse flange extending normal to the substantially flat surface thereof, and (iii) an outer portion substantially flat on the other said surfaces and defining a transverse flange extending normal to the substantially flat surface thereof; and (b) a through-hole in the nature of a keyway disposed on an adjacent sidewall on the other of the pair of adjacent channels, and having (i) a substantially planar inner portion defining a portion of a keyhole in the plane of said adjacent sidewall; and (ii) a substantially planar outer portion defining the remaining portion of a keyhole in a plane parallel to said adjacent sidewall plane;

said through-hole defining a large passageway enabling passage of said key, and a restricted passageway communicating with said large passageway and enabling passage of said key only via said large passageway;

whereby, when said key is fully inserted into said restricted passageway, said transverse flange of said outer portion of said key bears on an inner surface of said inner portion of said keyhole, and said transverse flange of said central portion of said key bears on an inner surface of said outer portion of said keyhole.

* * * * *

US005645176C1

(12) REEXAMINATION CERTIFICATE (4667th)

United States Patent

Jay

(10) Number: US 5,645,176 C1

(45) Certificate Issued: Nov. 5, 2002

(54) DISPLAY RACK WITH CHANNEL FRONT MEMBER

(75) Inventor: Richard Jay, Westport, CT (US)

(73) Assignee: Display Technologies, L.L.C., College Point, NY (US)

Reexamination Request:
No. 90/005,771, Jul. 14, 2000

Reexamination Certificate for:

| | |
|---|---|
| Patent No.: | **5,645,176** |
| Issued: | **Jul. 8, 1997** |
| Appl. No.: | **08/694,310** |
| Filed: | **Aug. 8, 1996** |

(21) Appl. No.: 08/694,310

(51) Int. Cl.[7] ..... A47F 1/04

(52) U.S. Cl. ..... 211/59.2; 211/59.3; 211/74; D6/408

(58) Field of Search ..... 211/59.2, 59.3, 211/74, 175, 184; 312/42, 71; 403/353, 735; D6/408

(56) References Cited

U.S. PATENT DOCUMENTS

| | | | | |
|---|---|---|---|---|
| 2,218,444 A | | 10/1940 | Vineyard | |
| 2,572,090 A | | 10/1951 | Allen | |
| 3,104,137 A | | 9/1963 | Cohen | |
| 3,780,873 A | | 12/1973 | Silva | |
| 3,894,634 A | | 7/1975 | Gotham et al. | |
| 4,106,668 A | | 8/1978 | Gebhardt et al. | |
| 4,191,296 A | | 3/1980 | Morgan | |
| 4,205,763 A | | 6/1980 | Merl | |
| RE30,706 E | | 8/1981 | Bustos | |
| 4,538,737 A | | 9/1985 | Delaney | |
| 4,552,272 A | | 11/1985 | Field | |
| 4,685,574 A | | 8/1987 | Young | |
| 4,694,966 A | | 9/1987 | Sorenson et al. | |
| 4,785,945 A | * | 11/1988 | Rowse et al. | 211/59.2 |
| 4,801,025 A | * | 1/1989 | Flum et al. | 211/59.2 X |
| 4,923,070 A | | 5/1990 | Jackle et al. | |
| 4,953,719 A | | 9/1990 | Spamer | |
| 5,024,336 A | * | 6/1991 | Spamer | 211/59.2 |
| 5,050,748 A | * | 9/1991 | Taub | 211/59.2 |
| 5,097,962 A | | 3/1992 | Eklof et al. | |
| 5,119,945 A | | 6/1992 | Wiggins | |
| 5,131,563 A | | 7/1992 | Yablans | |
| 5,351,838 A | * | 10/1994 | Flum | 211/59.2 |
| 5,450,968 A | | 9/1995 | Bustos | |
| D372,381 S | | 8/1996 | Goldring et al. | |
| 5,624,042 A | | 4/1997 | Flum et al. | |
| 5,634,564 A | | 6/1997 | Spamer et al. | |
| 5,788,090 A | | 8/1998 | Kajiwara | |

FOREIGN PATENT DOCUMENTS

| | | |
|---|---|---|
| DE | 9311276 | 11/1994 |
| GB | 2020197 | 3/1980 |

OTHER PUBLICATIONS

Photocopies of photographs and drawings of Flum Cool Glide IV product.

Photocopies of drawings of Flum Ultra–Glide display.

* cited by examiner

*Primary Examiner*—Robert Gibson

(57) ABSTRACT

A display rack for supporting and displaying articles, includes a plurality of elongate channels, each channel being of integral, one-piece, unitary construction formed in a single plastic molding operation. Each channel defines a pair of laterally spaced upstanding sidewalls, a substantially planar track connecting the sidewalls at the bottoms thereof, and a front member spaced above the track and connecting the sidewalls. The bottom of the front member, the front of the track, and the front of the sidewalls cooperatively define an aperture through which a substantial portion of a lead article in the channel may be viewed. The channels are secured in side-by-side, longitudinally parallel and transversely adjacent relationship. Preferably, the front of the track is devoid of any transversely extending upstanding lip or wall.

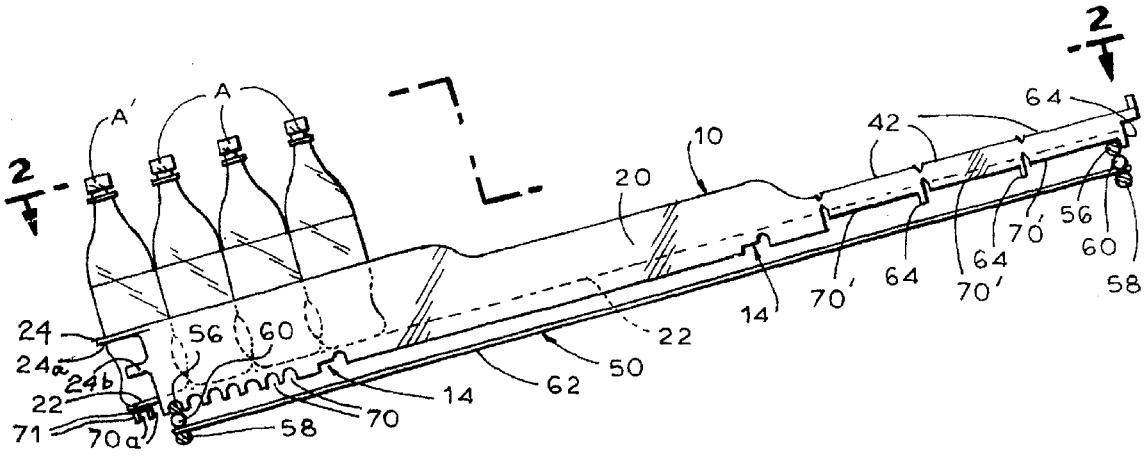

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2, 3, 12–16 and 20–28 is confirmed.

Claims 1, 4–11 and 17–19 are cancelled.

New claims 29–37 are added and determined to be patentable.

*29. A display rack for supporting and displaying upright elongate articles, comprising:*

(*A*) *a plurality of elongate channels, each said channel defining:*

(*i*) *a pair of laterally spaced upstanding sidewalls,*

(*ii*) *a substantially planar article-supporting track connecting said sidewalls at the bottom thereof, a front of said track extending forwardly beyond said sidewalls, and*

(*iii*) *a front member spaced above said track, secured to at least one of said sidewalls, and at least partially bridging said sidewalls, said front member extending forwardly beyond said sidewalls;*

*the bottom of said front member, the top of the front of said track, and the front of said sidewalls cooperatively defining an aperture through which an upright substantial portion of a lead article in said channel may be viewed; and*

(*B*) *means securing said channels in side-by-side, longitudinally parallel and transversely adjacent relationship.*

*30. The display rack of claim 1 wherein said front member is arcuate and extends arcuately forwardly beyond said sidewalls.*

*31. The display rack of claim 1 wherein said track front is arcuate and extends arcuately forwardly beyond said side walls.*

*32. The display rack of claim 1 wherein said front member extends forwardly beyond said track front, and said front member and said track front extend arcuately forwardly beyond said sidewalls.*

*33. The display rack of claim 1 wherein the front of said track extends forwardly beyond said sidewalls.*

*34. The display rack of claim 1 wherein said front member extends forwardly beyond said sidewalls.*

*35. The display rack of claim 29 wherein said front member is arcuate and extends arcuately forwardly beyond said sidewalls.*

*36. The display rack of claim 29 wherein said track front is arcuate and extends arcuately forwardly beyond said side walls.*

*37. The display rack of claim 29 wherein said front member and said track front are arcuate and extend arcuately forwardly beyond said sidewalls.*

* * * * *